United States Patent [19]

Farrissey, Jr. et al.

[11] 3,985,934

[45] Oct. 12, 1976

[54] POLYIMIDE FIBER HAVING A SERRATED SURFACE AND A PROCESS OF PRODUCING SAME

[75] Inventors: William J. Farrissey, Jr., Northford; Besir K. Onder, North Haven, both of Conn.

[73] Assignee: The Upjohn Company, Kalamazoo, Mich.

[22] Filed: May 8, 1975

[21] Appl. No.: 575,658

Related U.S. Application Data

[60] Continuation-in-part of Ser. No. 492,321, July 26, 1974, abandoned, and a continuation-in-part of Ser. No. 492,595, July 26, 1974, abandoned, which is a division of Ser. No. 405,777, Oct. 12, 1973, abandoned.

[52] U.S. Cl. ..... 428/397; 264/178 F; 264/210 F; 428/395; 428/400

[51] Int. Cl.[2] ..... D01D 5/06; D01D 5/12; D01D 5/24; D01F 1/08; D01F 6/74

[58] Field of Search..... 264/184, 178 F, 210 F; 260/65, 63 N; 428/358, 376, 395, 397, 400

[56] References Cited

UNITED STATES PATENTS

| | | | |
|---|---|---|---|
| 3,414,645 | 12/1968 | Morgan | 264/210 F |
| 3,529,051 | 9/1970 | Buckley et al. | 264/210 F |
| 3,577,387 | 5/1971 | Kersten et al. | 264/184 |
| 3,642,706 | 2/1972 | Morgan | 264/178 F |
| 3,673,160 | 6/1972 | Buisson et al. | 264/184 |
| 3,708,458 | 2/1973 | Alberino et al. | 260/63 N |

*Primary Examiner*—J.C. Cannon

*Attorney, Agent, or Firm*—James S. Rose; Denis A. Firth

[57] ABSTRACT

High temperature resistant aromatic copolyimide fibers are disclosed together with processes for their preparation by wet and dry spinning techniques from solvent soluble copolyimides. The latter are prepared from benzophenone-3,3′,4,4′-tetracarboxylic acid dianhydride and a mixture of 4,4′-methylenebis(phenyl isocyanate) and toluene diisocyanate (2,4-, or 2,6-isomer, or mixtures thereof). The wet spinning process can be stopped at any one of the stages taught, to yield useful fibers. The choice of coagulant fluid in the spin bath controls the fiber cross-section which in turn controls certain fiber characteristics. When glycerine or a low molecular weight aliphatic glycol is employed as coagulant fluid, the high temperature fiber obtained has advantageous properties which are otherwise difficult or impossible to obtain.

8 Claims, 4 Drawing Figures

POLYIMIDE FIBER HAVING A SERRATED SURFACE AND A PROCESS OF PRODUCING SAME

CROSS REFERENCE TO RELATED APPLICATION

This application is a continuation-in-part of our copending applications Ser. No. 492,321 and Ser. No. 492,595 both filed July 26, 1974 both now abandoned, which were divided from our copending application Ser. No. 405,777 filed October 12, 1973 now abandoned.

BACKGROUND OF THE INVENTION

1. Field of the Invention

This invention relates to novel heat and fire resistant fibers and is more particularly concerned with a particular class of novel copolyimide fibers and methods for their preparation.

2. Description of the Prior Art

Aromatic polyimide fibers are known and their preparation is taught in the art, see "Man-Made Fibres" by R. W. Moncrieff, Fifth Edition 1970, pgs. 618–619, John Wiley & Sons, Inc., New York, N.Y.; U.S. Pat. No. 3,415,782; and G. B. 1,188,936. Aromatic polyimides are usually found to be organic solvent insoluble. The prior art discloses the preparation of fibers by spinning a solvent soluble intermediate polyamide-acid, or polyamide-acid salt solution either by wet or dry spinning techniques to a polyamide-acid fiber. The resulting fiber is converted to the corresponding polyimide either by heat or chemical methods. Aside from the disadvantage of a second imidizing step, the prior art has an additional limitation. This is the susceptibility of the polyamide-acid polymer to hydrolytic degradation and the concomitant care required in its handling and spinning in order to maintain proper molecular weight and physical properties in the final fiber, see U.S. Pat. No. 3,415,782.

The preparation of soluble aromatic copolyimides is disclosed in U.S. Pat. No. 3,708,458. We have now found that the soluble aromatic copolyimides of the aforesaid U.S. patent can be wet or dry spun directly from their solutions to obtain fibers possessing physical properties comparable to commercial nylon and polyester fibers. The fibers so obtained in the present invention possess good heat and fire resistance. It will be apparent to one skilled in the art that the direct spinning of high temperature resistant, aromatic polyimide fibers represents a marked advance over methods hitherto known and employed in the art.

We have also found that fiber cross-section can be modified by the choice of coagulant fluid employed in the wet spinning process. Fibers are obtained having advantageous properties such as high bulk (low density) good covering properties, good nonconductive (thermal) properties. The fibers can be easily crimped by heat relaxation. When a low molecular weight aliphatic diol, triol, or aqueous solution thereof is used as the coagulant, the fibers are obtained having an irregular cross-section and pseudo-hollow structure which results in the advantageous properties listed hereinabove. Various techniques are known in the fiber art for lowering fiber density by introducing gas into the polymer before spinning. Sodium carbonate incorporated into viscose forms carbon dioxide bubbles when the spinning solution is passed into an acid coagulating bath. Air has been blown intermittently through a single spinneret orifice to introduce air bubbles into viscose (see "Man-Made Fibres", p. 205, supra). The use of the class of coagulants hereinabove described in the present invention achieves the low density fiber directly.

SUMMARY OF THE INVENTION

This invention comprises a filament comprising a copolyimide having the structure:

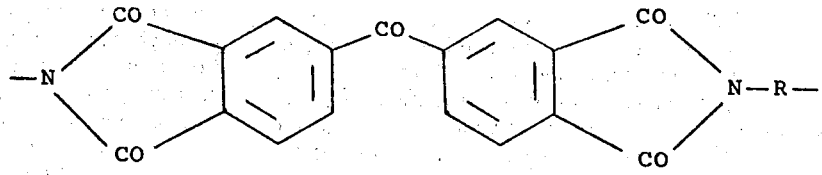

(I)

wherein from 10 to 30 percent of said recurring units are those in which R represents:

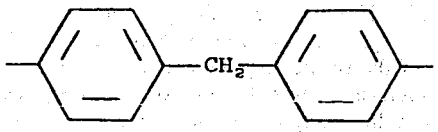

and the remainder of said units are those in which R represents a member selected from the group consisting of

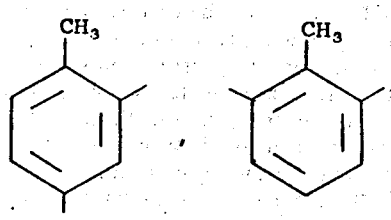

and mixtures thereof.

Also according to the invention there is provided a process for producing filaments characterized by an irregular interrupted annular cross-section by wet spinning. The filaments are also produced by dry spinning.

DETAILED DESCRIPTION OF THE INVENTION

Figure 1:
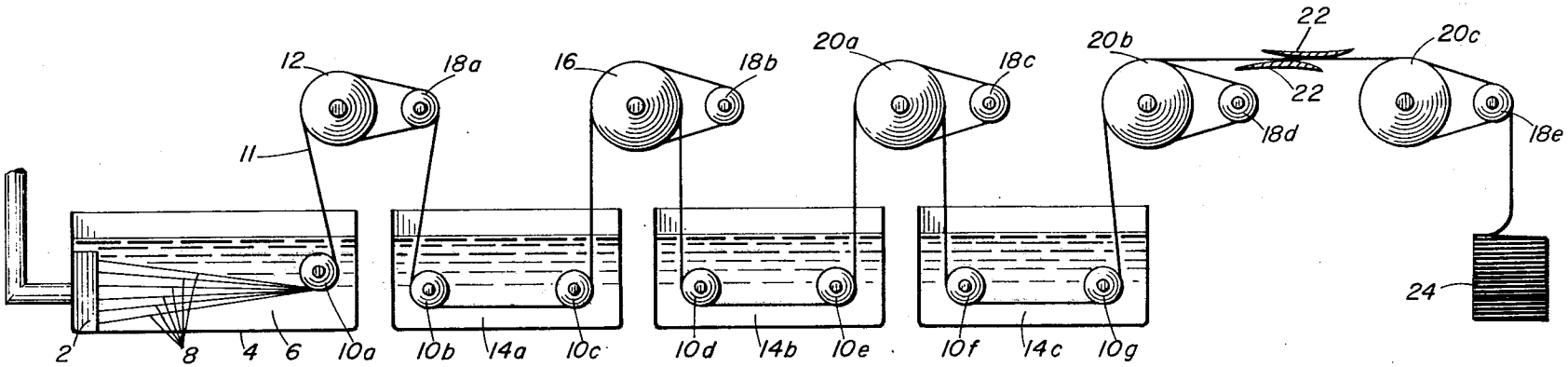
FIG. 1 is a schematic illustration of one embodiment of a spinning and drawing apparatus used in the invention.

The copolyimides having the recurring unit (I) can be prepared by the procedures which are described in detail in U.S. Pat. No. 3,708,458. Thus, the various copolyimides having this recurring unit are obtained by condensing benzophenone-3,3',4,4'-tetracarboxylic acid dianhydride (BTDA) with a substantially stoichiometric amount of a mixture of toluene diisocyanate and methylenebis(phenyl isocyanate) or a mixture of the corresponding diamines under conditions which are described in detail in the aforesaid U.S. patent. The relative molar proportions in which the toluene diisocyanate and the methylenebis(phenyl isocyanate) [or the corresponding diamines] are employed determines the proportion in which the recurring units corresponding to these starting materials occur in the ultimate copolyimide. The relative molar proportions in which the two diisocyanates are employed also determines the solubility of the resulting polyimides in dipolar aprotic solvents such as dimethyl sulfoxide, dimethylacetamide, dimethylformamide, hexamethylphosphoramide, N-methyl-2-pyrrolidone, tetramethyl urea, tetramethylenesulfone, and the like. It is found that said copolyimides in which the proportion of recurring units derived from toluene diisocyanate is relatively high, of the order of 70 pecent of higher, possess marked solubility in the aforesaid solvents. The optimum combination of solubility with other physical properties such as structural strength and high temperature stability of the resultant copolyimides is advantageously achieved when the proportion of recurring units derived from methylenebis(phenyl isocyanate) is from 10 percent to 30 percent and the proportion of those units derived from toluene diisocyanate is from 70 percent to 90 percent. The toluene diisocyanate may be either the pure 2,4- or the 2,6-isomer, or mixtures thereof.

In addition to the recurring unit (I), other polymer units can be present in minor amounts (0.1 molar percent to 15 molar percent) in the polyimides from which the fibers are derived provided that the said other units do not have an adverse effect on the physical properties of the fibers of this invention. Said other units can be present as copolymer units with the recurring unit (I), or as a physical mixture with them. The minor polymer constituents can be characterized either by a single polymer unit, or by copolymer units. A preferred class of minor constituents are the aromatic polyamides. A particularly preferred type of aromatic polyamide is that having a recurring unit of the formula (II).

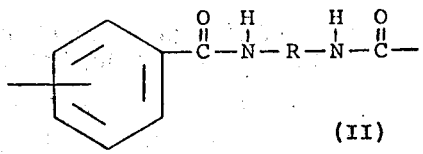

(II)

wherein R represents a member selected from the group consisting of

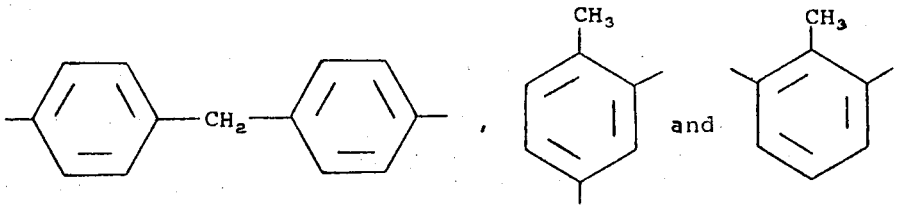

The preferred polyamides can be prepared separately as taught in German Offen. No. 1,926,062 by the reaction of the appropriate aromatic diacid with the desired aromatic diisocyanate. Alternatively, the polyamide can be copolymerized with the copolyimide of the present invention preferably when the copolyimide is being prepared by the dianhydride-diisocyanate polymerization as taught in U.S. Pat. No. 3,708,458.

The high temperature resistant fibers of the present invention can be readily prepared by employing either wet or dry spinning techniques known to those skilled in the art. The soluble polyimides of the present invention are dissolved in any one of the aforementioned dipolar aprotic solvents. The resulting spin dope advantageously contains from about 10 percent solids to about 30 percent solids, but preferably about 15 percent solids to about 20 percent solids. The actual concentration range is not in itself critical other than whatever control it exercises over the bulk viscosity of the dope. The bulk viscosity is advantageously from about 30,000 cps. to about 1,000,000 cps. but is preferably about 50,000 cps. to about 500,000 cps. In just one of the advantageous features to flow from the present invention, we have found that the presence of trace amounts of moisture, or the use of elevated temperatures is in no way critical to carrying out the process of the invention.

The wet spinning process employed in the present invention is not restricted with regard to apparatus but is adaptable to all types of apparatus varying in size and output. FIG. 1 is a schematic illustration of an apparatus which can be used in the practice of one embodiment. The spin dope is fed via a gear pump (not shown) under pressure from a tank or reservoir to the spinneret (2).

The spinneret can be equipped with any desired number of holes. It will be recognized by those skilled in the art that a single hole produces a monofilament or fiber (the terms "filament" and "fiber" are used synonymously herein), while a plurality of holes produces the filaments or fibers individually which become a filament bundle subsequent to their coagulation. Such a bundle is also known as tow. When the spinneret is equipped with thousands of orifices, the fibers are then produced as tow which is converted to staple by cutting into short sections prior to being spun into a yarn.

The spinneret is positioned beneath the surface of the liquid coagulant (6) contained in the spin bath (4). It is desirable, but not essential, for the emerging fibers (8) to pass through a spin tube within the bath. The spin tube is an open-ended tube placed within the spin bath to allow free fluid flow around the moving fibers as they pass through while shielding them against the effects of turbulence. The coagulant fluid is chosen from a variety of non-solvents, or mixtures of solvents, as long as they act in a non-solvent capacity for the copolyimides. That is, the coagulant fluid causes the precipitation of the copolyimide as the spin dope emerges from the spinneret holes. Illustrative of the coagulant fluids that are used are aqueous solutions of the following dipolar aprotic solvents, N-methylpyrrolidone, dimethylacetamide, dimethyl formamide, dimethyl sulfoxide, hexamethylphosphoramide, tetramethyl urea, tetramethylenesulfone and mixtures of the solvents themselves with water. The water content in these solutions is advantageously from about 25 percent to about 75 percent. In like fashion the lower alkanol solutions of these aforesaid dipolar aprotic solvents, said solutions containing from about 25 percent to about 75 percent of the lower alkanol, can serve as coagulant fluids. The lower alkanols are those containing from 1 to 8 carbon atoms, inclusive, such as methyl alcohol, ethyl alcohol, propyl alcohol, butyl alcohol, amyl alcohol, hexyl alcohol, heptyl alcohol, octyl alcohol, and isomers thereof. Further illustrative of coagulant fluids are solutions of the aforementioned dipolar aprotic solvents with lower aliphatic ketones. The concentration of ketone in such solutions is advantageously from about 25 percent to about 75 percent. Examples of lower aliphatic ketones are acetone, methyl ethyl ketone, methylisopropyl ketone, methylisobutyl ketone, diisopropyl ketone, and the like.

A preferred class of coagulant fluids consists of the lower alkylene glycols, lower dialkylene glycols, glycerine and aqueous solutions thereof. The latter can contain from about 25 percent water to about 75 percent water by weight. Typical examples of the lower alkylene glycols are ethylene glycol, propylene glycol, butylene glycol and the like. Typical examples of the lower dialkylene glycols are diethylene glycol, dipropylene glycol, dibutylene glycol and the like. An even more preferred coagulant fluid is glycerine and its aqueous solutions which latter contain advantageously from about 0 percent to about 75 percent water.

As a particularly novel and advantageous feature of the present invention, the cross-sectional shape, can be modified through the use of the preferred class of coagulant fluids set forth hereinabove. In contrast, if the spin bath consists of an aqueous solution of a dipolar aprotic solvent such as N-methylpyrrolidone or dimethylformamide, the initial fiber structure (before complete drying) is the normal round fibrillar structure. Upon complete solvent removal, the fiber becomes solid and elliptical in cross-section.

Figure 2:
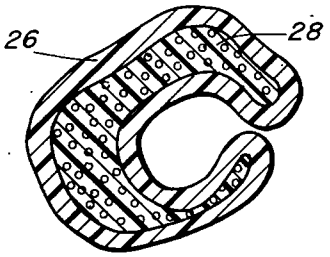
FIG. 2 is a cross-sectional view along the axis of a polyimide fiber of the invention before complete solvent removal.
Figure 3:
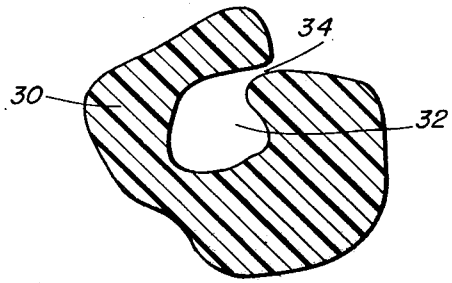
FIG. 3 is a cross-sectional view along the axis of a polyimide fiber of the invention after complete solvent removal.

When a member of the preferred class of coagulant fluids is employed, the fibers during the complete drying stage possess an irregular interrupted annular cross-section. FIG. 2 shows a typical cross-section of a fiber as formed in the first "as-spun" state from glycerine. The fiber still contains a minor proportion of organic solvent which is present as a magma of solvent and polyimide represented by (28). This core is surrounded by a skin (26) of polyimide essentially free of solvent. The cross-section of the fiber at this stage is irregular and beginning to show the presence of a void, or pseudo-hollow condition. During the complete drying of the fiber all the solvent is removed and a typical fiber cross-section is now as shown in FIG. 3. What was begun as represented in FIG. 2 is completed by the drying process and represented in FIG. 3. The polyimide (30) forms a distorted ring interrupted by a narrow channel (34) opening into its interior (32) and the surface of the ring assumes an irregular shape. The fiber is pseudo-hollow, i.e. it resembles a hollow fiber except for the narrow opening (34). The irregular surface of the fiber (sometimes referred to in the art as serrated), combined with the pseudo-hollow structure are the reasons for the advantageous high bulk properties of the fibers of the invention as discussed hereinabove.

Figure 4:
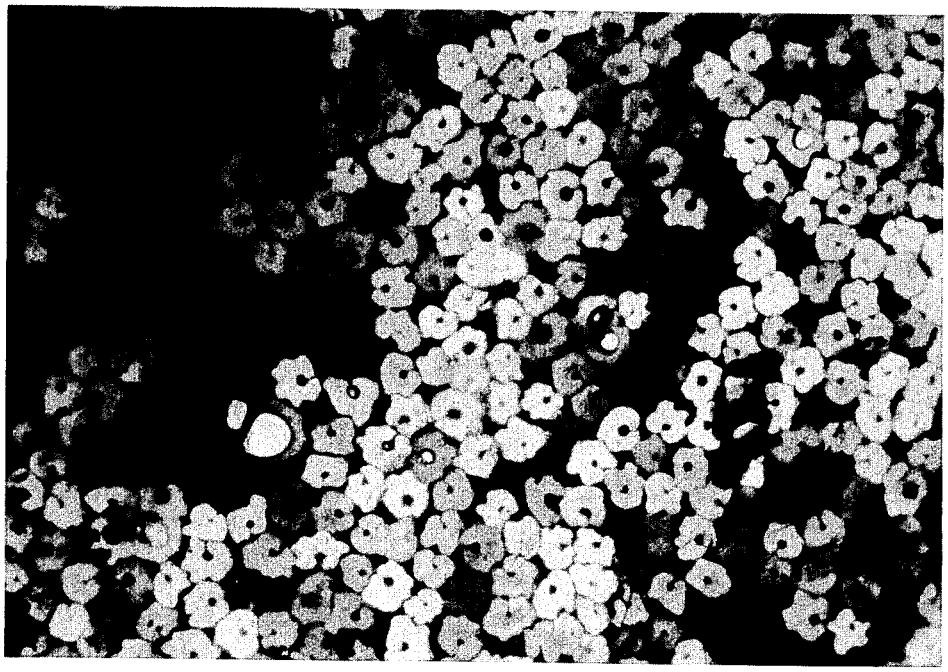
FIG. 4 is a photomicrograph of a cross-sectional view along the axes of a bundle of polyimide fibers of the invention.

The characteristic cross-sectional shape of the fibers of the invention is further illustrated in FIG. 4. The latter shows a cross-sectional view along the axes of a bundle of the preferred polyimide fibers of the invention taken at a magnification of 60X. The predominant shape represented in FIG. 3 and described hereinabove can be seen from FIG. 4. The opening or channel, shown in FIG. 3 as (34), can readily be seen in the majority of the fibers. In a few random instances there are fibers completely enclosing a hollow and not having an opening such as (34).

The fibers (8) formed in the coagulant bath pass under a guide roller (10*a*) where they form a filament bundle (11) and are picked up by the take-up roller (12) and finger guide (18*a*) whose speed can be adjusted to cause a slight stretch of the fibers in the bath. This is commonly known as "jet stretch" and is preferably from a draw of 1.0X to 3.0X. The fibers are then passed through at least one aqueous wash bath (14*a*) by way of guide rollers (10*b*) and (10*c*) while the bath can vary in temperature from about 0° C to about 100° C. Preferably the temperature of this bath is in the range of about 25° C to about 65° C. The bath contains a surfactant which aids in the removal of organic solvent from the fibers and thereby prevents cohesion between them in the filament bundle. Surfactants possessing at least some solubility in water are preferred and are exemplified by the following: nonionic surface active agents such as the polyoxypropylene polyoxyethylene copolymers (Pluronic Polyols, products of BASF Wyandotte Chem. Inc.); long chain fatty acid partial esters of hexitol anhydrides (Spans, products of Atlas Powder Co.); polyoxyalkylene derivatives of hexitol anhydride partial long chain fatty acid esters (Tweens, products of Atlas Powder Co.); the metallic soaps, including zinc, aluminum, calcium, magnesium, barium and strontium stearates, zinc laurate, calcium oleate; and sorbitan monopalmitate. A particularly preferred class of surfactants is comprised of the water soluble silicones such as the polyalkyleneoxy polydimethylsiloxanes containing hydroxyl groups. Typical of this preferred class is the surfactant available commercially as DC-193 and referred to as a "silicone - glycol copolymer" (see, "Dow Corning Silicone Notes", Dow Corning, 113, Bulletin: 05-042, May 1963 and Dow Corning 193, Bulletin: 05-146, February, 1966). In addition to functioning as surfactants in the wash bath to aid in solvent removal, this latter class of silicones containing hydroxyl groups possesses even further advantages. Their use results in fibers possessing good lubricant properties during formation, excellent antistatic behavior, and good luster in the finished product.

The surfactant is employed in the wash bath from about 0.1 percent to about 5.0 percent but preferably from about 0.5 percent to about 2.0 percent.

The filaments are picked up by a roller (16) and drawn while a finger guide (18*b*) controls the number of turns on the roller. The filaments can proceed directly to one or more drying rollers (20*a*, 20*b*, 20*c*) and their corresponding finger guides (18*c*, 18*d*, and 18*e*), with drawing, or, optionally, passing through further washing baths (14*b*, 14*c*) by way of guide rollers (10*d*, 10*e*, 10*f*, 10*g*) while being drawn over at least one drying roller (20*a*, 20*b*, 20*c*). The temperature range of the rollers (20*a*, 20*b*, 20*c*) is preferably from about 100° C to about 220° C when they are being used for drying and can increase from the first roller (20*a*) to subsequent rollers (20*b*) and (20*c*) within the range from 100° C to 200° C. In an optional step in the first spinning stage, the filaments are passed between a pair of hot shoes (22) placed before a last roller (20*c*). The shoes (22) serve as tension controllers by softening the fibers as they are not yet completely solvent free and are heated from about 150° C to about 240° C. The shoes are adjustable so that the contact length with the fibers can be varied. The total draw ratio in this spinning stage is from about 1X to about 3X and the fiber can be optionally collected (24) or taken to a final drying stage. At least 75 percent of the volatile material is removed during the combined spinning and drawing to prevent cohesion between the fibers. The volatiles content is normally about 5 percent to about 10 percent in the as-spun condition. The fibers of this embodiment containing residual solvent find utility in the new area of spun-bonded cloth (see R. W. Moncrieff, pgs. 682–697, supra.) wherein the fibers may be bonded to either different webbing material or with themselves. Solvent removal provides fire resistant and heat resistant textile grade fibers useful in many applications such as aircraft construction and in public buildings.

Complete drying to remove the remaining volatiles is accomplished in any convenient fashion. The fiber can be dried by heating in vacuum at about 180° C for about 8 hours to about 16 hours. Alternatively, it can be cycled back to the rollers (20*b*) and (20*c*) which are heated at 160° C to 230° C at zero draw and optionally over the hot shoes (22) at 200° C to 220° C.

After complete solvent removal, the fibers so produced have not attained their maximum physical properties but are highly useful type filaments which find particular use in high strength, high temperature laminates and high temperature reinforced plastics when strands or roving of the copolyimide fibers are laminated or embedded in polymer materials such as aromatic polyamides, polyimides, polyamide-imides, polybenzimidazoles, polysulfones, polycarbonates, and other like engineering thermoplastics known in the art.

Orienting the fibers after they are free of solvent increases their tenacity and elongation to high levels. Orienting or hot drawing, as it is sometimes referred to in the art, converts them into textile grade, fine filaments having good tensile properties in the range of regular nylon and polyester fibers. The hot drawing is accomplished by feeding the fully dried fiber from a tension controller to a roller (20*b*) and over the hot shoes (22) at a temperature at least as high as the glass transition temperature, or from about 325° C to about 400° C. The fibers then pass to a final roller (20*c*) at a draw ratio up to about 5.0X and thence to a Leesona packager. The fibers so obtained represent yet another embodiment of the present invention and find utility in applications referred to hereinbelow.

In yet another and most preferred embodiment of the present invention, the oriented copolyimide is tempered or heat relaxed by passing the fiber over hot shoes at a temperature at least as high as the orienting temperature from about 325° C to about 400° C. The fiber is allowed to relax and is packaged.

The polyimide solutions referred to hereinabove can also be used for the direct dry spinning of the polyimide filaments of the present invention. The techniques of dry spinning known to those skilled in the art are used. In just one embodiment, the polyimide solution is pumped to a spinneret equipped with 8 orifices, 10 mils in diameter and positioned at the top of a 16 foot dry spinning tower. The fiber emerges in a stream of heated nitrogen and is passed vertically and downwardly through a series of heated zones from about 150° C to about 340° C. The fibers are pulled and collected at the bottom by a friction winding device. Hot drawing of the fiber produces tensile properties in the range of polyester fibers.

The fibers of the present invention are characterized by good flame and heat resistance. The LOI test (Limiting-Oxygen Index test carried out in accordance with the ASTM Test Method D-2863) shows a 36.4% value for Ignition LOI and 35.9% for Extinguishing LOI. Ignition LOI is the oxygen content of the oxygen-nitrogen mixture required in order to sustain burning for more than 3 minutes after the top of a polyimide fiber bundle is ignited with a hydrogen flame. Extinguishing LOI is the oxygen content of the gas mixture at which the fiber bundle extinguishes in 3 minutes.

Typically, the strength retention of the fiber at 200° C is at least 75% and at 250° C is at least 60%. Similarly, typical fibers have sufficient viscoelastic strength to support a load of at least 0.05 g/den. through the glass transition temperature (about 300–325° C) until breakage at 563° C. Retention of critical properties is very good at 250° C and 50% of the original strength is still maintained after 100 hours at 300° C.

The copolyimide fibers of the invention find utility in applications requiring high flame resistance such as aircraft furnishings, space application, protective clothing, rescue services, specialty furnishings such as drapes, upholstery, toys, and the like. In addition, due to their high temperature stability, they find utility in industrial filters, hot gas filtration, filtration of corrosive chemicals, electrical insulation of cables and wires, paper for electrical insulation, non-woven fabrics for protective applications, felts for filtration, and like applications. The copolyimide fibers possess the additional advantage of being stable to ultra-violet irradiation by virtue of their molecular structure which includes the benzophenone grouping, a well-known ultraviolet absorbing moiety.

The following examples describe the manner and process of making and using the invention and set forth the best mode contemplated by the inventors of carrying out the invention but are not to be construed as limiting.

EXAMPLE 1

The polyimide employed in the following example was a copolyimide prepared by reacting benzophenone-3,3′,4,4′-tetracarboxylic acid dianhydride with a stoichiometric amount of a mixture containing 80 molar percent of toluene diisocyanate and 20 molar percent of 4,4'-methylenebis(phenyl isocyanate) using the procedure set forth in Example 4 of U.S. Pat. No. 3,708,458.

A 15% solution of the above copolyimide in N-methylpyrrolidone was prepared and had a bulk viscosity of about 300,000 cps. It was placed in a 2000 ml. container and deaerated under reduced pressure. It was then fed at a temperature of 65°C under nitrogen pressure of 20 – 25 psi to a Zenith metering pump (size ¼, displacement = 0.160 ml./rev.) which pumped the dope to a first pressure gauge and through a 60 micron porosity in-line filter, then through a second pressure gauge to a spinneret equipped with an array of 44 openings, 150 microns each in diameter. The coagulating bath contained glycerine at 26° C. Extrusion pressure was about 65 psi before the filter and 25 psi after it. Emergent fibers were led through a 3" × 36" spin tube which was immersed in the coagulating bath to minimize the effects of turbulence on the fresh fibers. The latter were passed under a guide roller in the bath and picked up by a take-up roller whose speed was adjusted to cause a slight stretch of the fibers ("jet-stretch" = speed of fibers on take-up roller/speed of emerging fluid) in the bath of about 1.5X. The filament bundle was led through a first washing bath of water at 25° C containing 1.0% of surfactant DC-193* at a draw ratio of 1.61X over a second roller. Then through a second washing bath at 55° C containing a solution identical to the first wash bath and drawn 1.2X over a third roller which was at a temperature of 100°–140° C where the first drying stage was initiated. The bundle was led through a third washing bath at 50°–65° C and containing the same aqueous solution as the two preceding wash baths and over a fourth roller (second drying roller) at 140°–180° C at a draw of 1.04X. The fibers were then led between, and in contact with, a pair of hot shoes which were inverted toward each other and mounted between the fourth and fifth roller. The shoes were at 150°–240° C and acted as tension controllers as the fiber bundle was drawn over their surfaces to the fifth and final roller at 200°–220° C and a draw ratio of 1.2X to a packager. Total draw ratio was 2.42X. Complete solvent removal from the fiber was accomplished by either drying in vacuumat 180° C for 8 to 16 hours, or else repassing the fibers over the fourth roller at 160°–180° C, between the hot shoes at 200°–220° C and over the fifth roller at 225°–230° C with zero draw. The final fibers had an irregular interrupted annular cross section and had the following physical properties.

*See Dow Corning Bulletin: 05-146, February, 1966.

| | |
|---|---|
| Density, d. | 8 |
| Tenacity, gm./d. | 1.27 |
| Elongation % | 6.4 |
| Initial modulus, gm./d. | 32.0 |
| Work recovery % (2% strain) | 91.0 |

-continued

| | |
|---|---|
| 1% Offset yield, gm./d. | 1.21 |

The irregular interrupted annular cross-section of the fibers prepared in accordance with this Example is shown in the photomicrograph of FIG. 4. It is a 60X magnification view along the axes of a fiber bundle.

EXAMPLE 2

The orientation or hot drawing of the polyimide fiber obtained from Example 1 was accomplished by using part of the "spinning frame" described in the Example 1. The fiber was fed from a tension controller to the fourth roller and through the hot shoes which were at a temperature of 340° C – 400° C and to the fifth roller and finally to a Leesona packaging unit. The total draw ratio varied from 2.5X to 5.0X. The following Table I describes the conditions used to orient the polyimide fiber starting with the fiber obtained from Example 1 and referred to as Ex. 1.

TABLE I

| | Starting Fiber | Supply Speed (m./min.) | Hot Shoes (°C) | Draw R. (X) | Double Draw R. (X) |
|---|---|---|---|---|---|
| Ex. 2 A | Ex. 1 | 9.7 | 360 | 2.5 | |
| Ex. 2 B | Ex. 1 | 9.7 | 360 | 2.71 | |
| Ex. 2 C | Ex. 2 A | 9.5 | 360 | 1.25 | 3.12 |
| Ex. 2 D | Ex. 2 A | 9.5 | 360 | 1.62 | 4.05 |
| Ex. 2 E | Ex. 2 A | 9.5 | 375 | 2.0 | 5.0 |

The comparison of physical properties of the fibers obtained as well as the starting non-oriented fiber, is shown in Table II.

TABLE II

| | Draw Ratio | Density (d.) | Tenacity (cm./d.) | Elongation (%) | Initial Mod. (cm./d.) | Work Recovery (%) (2% strain) | 1% Offset Yield (cm./d.) |
|---|---|---|---|---|---|---|---|
| Ex. 1 | As-Spun | 8 | 1.27 | 6.4 | 32.0 | 91.0 | 1.21 |
| Ex. 2 A | 2.50X | 3 | 2.37 | 32.8 | 69.0 | 70.0 | 1.41 |
| Ex. 2 B | 2.71X | 3 | 2.08 | 32.8 | 65.0 | 85.0 | 1.33 |
| Ex. 2 C | 3.12X | 3 | 1.95 | 36.8 | 56.0 | 75.0 | 1.18 |
| Ex. 2 D | 4.05X | 2 | 2.65 | 30.2 | 68.0 | 72.0 | 1.58 |
| Ex. 2 E | 5.00X | 2 | 2.56 | 28.2 | 70.0 | 71.0 | 1.49 |

EXAMPLE 3

Heat relaxation or tempering of oriented polyimide fibers was accomplished by using the same part of the "spinning frame" utilized in Example 2. A sample of the Ex. 2 A fiber previously oriented by drawing over the hot shoes at 360° C and a draw of 2.5X, was passed over the fourth roller and between the hot shoes at 350° C and finally over the fifth roller to a Leesona packaging unit at a draw ratio of 0.77X (i.e. a shrinkage of approximately 23%). The advantage of tempering the oriented fibers is shown in Table III by comparing the shrinkage of the polyimide fibers in the as-spun, the drawn or oriented, and the relaxed state, when the three different fibers are subjected to the temperatures indicated for 10 minutes.

TABLE III

| | Percent Shrinkage of Polyimide Fibers After 10 Minutes at Given Temperature (°C) | | | | |
|---|---|---|---|---|---|
| | 250 | 275 | 300 | 325 | 350 |
| As-spun | 0 | 0.5 | 2.1 | 7.0 | 14.0 |

TABLE III-continued

| Percent Shrinkage of Polyimide Fibers After 10 Minutes at Given Temperature (°C) | | | | | |
|---|---|---|---|---|---|
| | 250 | 275 | 300 | 325 | 350 |
| Drawn 4X | 0.5 | 2.0 | 10.0 | 45.0 | 60.0 |
| Relaxed ≈ 20% | 0 | 0.5 | 4.2 | 14.6 | 29.0 |

We claim:

1. A filament characterized by a serrated and interrupted annular cross-section said filament comprising a copolyimide having the structure

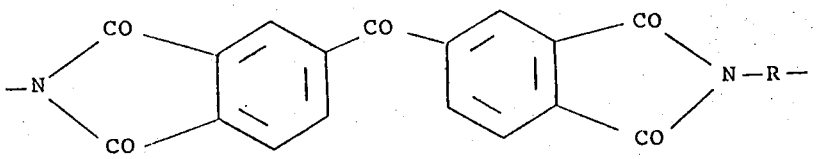

wherein from 10 to 30 percent of said recurring units are those in which R represents

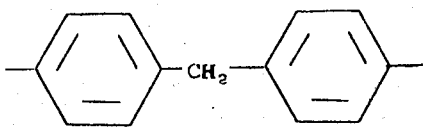

and the remainder of said units are those in which R represents a member selected from the group consisting of

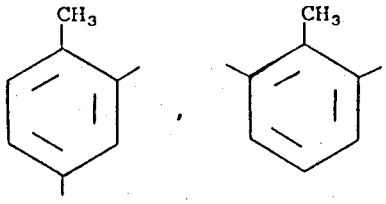

and mixtures thereof.

2. A filament according to claim 1 wherein 20 percent of said recurring units are those in which R represents

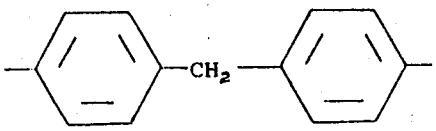

and the remaining 80 percent of said recurring units are those in which R represents a member selected from the group consisting of

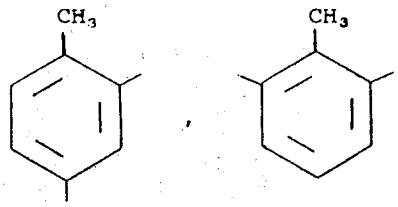

and mixtures thereof.

3. A process for the production of copolyimide filaments characterized by a serrated and interrupted annular cross-section comprising the steps of:

a. forming a copolyimide filament by spinning a dipolar aprotic solvent solution of a copolyimide having the structure

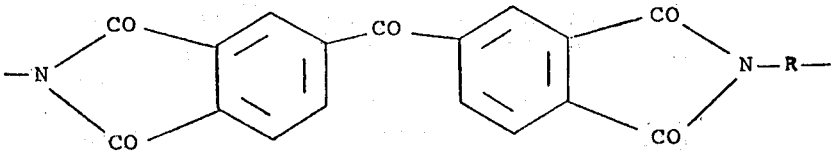

wherein from 10 to 30 percent of said recurring units are those in which R represents

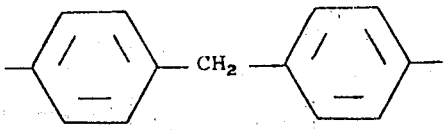

and the remainder of said units are those in which R represents a member selected from the group consisting of

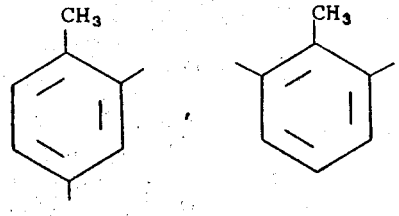

and mixtures thereof, directly into a coagulant bath comprising a member selected from the group consisting of lower monoalkylene glycols, lower dialkylene glycols, glycerine, and solutions thereof with water;

b. passing said filament through at least one aqueous bath containing from about 0.5 percent to about 2.0 percent of a surfactant;

c. removing at least 75 percent of the volatiles from said washed filament by passing it over at least one roller heated to a temperature from about 100° C to about 220° C while drawing it to a total draw ratio from about 1X to about 3X;

d. drying said filament to remove the remaining volatiles;

e. orienting said filament by drawing it over a surface heated from about 325° C to about 400° C to a draw ratio up to about 5X and;

f. tempering said filament by passing it over a surface at a temperature at least as high as the orienting temperature, said surface being disposed between two rollers, and allowing the filament to relax.

4. The process according to claim 3 wherein the copolyimide has the structure

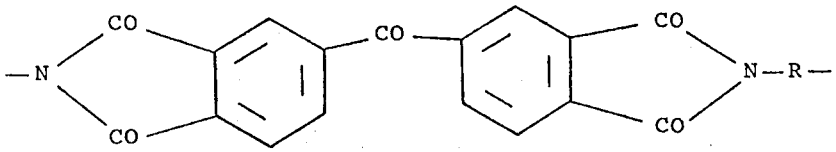

wherein 20 percent of said recurring units are those in which R represents

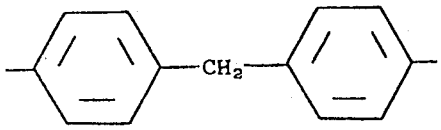

and the remainder of said units are those in which R represents a member selected from the group consisting of

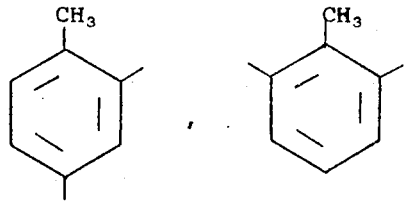

and mixtures thereof.

5. The process according to claim 3 wherein the dipolar aprotic solvent is N-methylpyrrolidone.

6. The process according to claim 3 wherein said dipolar aprotic solvent solution of copolyimide employed as the spinning solution contains from about 10 percent to about 30 percent by weight of said copolyimide.

7. The process according to claim 3 wherein said surfactant employed in step (b) is a polyalkyleneoxy polydimethylsiloxane containing hydroxyl groups.

8. The process according to claim 3 wherein the coagulant bath comprises glycerine.

* * * * *